US005961191A

United States Patent [19]

Taylor

[11] Patent Number: 5,961,191

[45] **Date of Patent: *Oct. 5, 1999**

[54] PICNIC CADDY

[76] Inventor: Charles M. Taylor, 1524 Nova Ave., Capitol Heights, Md. 20743

[ * ] Notice: Under 35 U.S.C. 154(b), the term of this patent shall be extended for 323 days.

[21] Appl. No.: 08/493,463

[22] Filed: Jun. 22, 1995

[51] Int. Cl.[6] ..... A47B 57/00

[52] U.S. Cl. ..... 312/34.8; 312/902; 108/26; 108/98

[58] Field of Search ..... 108/25, 26, 29, 108/30, 42, 50.011, 92, 97, 98, 99, 100, 101, 166, 179, 193, 24, 152, 14, 16, 17, 18; 312/34.1, 34.8, 902; 211/86, 71; 248/316.1; 206/499; 383/66, 81, 97

[56] References Cited

U.S. PATENT DOCUMENTS

| | | | |
|---|---|---|---|
| 177,766 | 5/1876 | Stephen . | |
| 696,790 | 4/1902 | Atkinson . | |
| 1,072,248 | 9/1913 | McNaughton | 211/86 X |
| 1,235,097 | 7/1917 | Berg . | |
| 1,458,679 | 6/1923 | Bishop . | |
| 1,824,822 | 9/1931 | Kradolfer | 108/97 X |
| 1,940,454 | 12/1933 | Karnes | 108/97 X |
| 1,956,696 | 5/1934 | Rice | 108/25 X |
| 2,199,895 | 5/1940 | Sharp | 108/99 X |
| 2,266,274 | 12/1941 | Schroeder | 108/42 X |
| 2,707,379 | 5/1955 | Guior | 312/244 X |
| 2,731,182 | 1/1956 | Higgins | 383/97 X |
| 2,897,910 | 8/1959 | Steely et al. | 108/99 X |
| 2,926,794 | 3/1960 | Karoff | 108/26 X |
| 3,669,168 | 6/1972 | Beaudin | 383/66 X |
| 5,244,268 | 9/1993 | Derrickson | 312/293.2 X |
| 5,480,058 | 1/1996 | Hutchins | 224/282 X |

*Primary Examiner*—Janet M. Wilkens
*Attorney, Agent, or Firm*—Evenson, McKeown, Edwards & Lenahan, PLLC

[57] ABSTRACT

A picnic caddy is provided having first and second upright support pillars arranged in a parallel spaced apart relationship with respect to one another. A clamping mechanism is arranged at one end of the first and second upright support pillars for securing the picnic caddy to a picnic table or other horizontal surfaces. A first tray extends laterally away from one side of the upright support pillars. A second tray extends laterally away from another side of the upright support pillars. The first and second trays are provided with compartments for holding various picnic items and can include storage boxes for utensils, napkins and the like. In this manner, an advantageous and efficient picnic caddy is provided for picnic usage.

18 Claims, 4 Drawing Sheets

PICNIC CADDY

FIELD OF THE INVENTION

This invention relates to a device for storing and holding objects and, more particularly, to a caddy device for storing and holding objects commonly associated with picnics and other indoor and/or outdoor activities.

BACKGROUND OF THE INVENTION

Traditionally, many families, as well as friends, enjoy meeting and gathering outdoors for picnics and the like. In fact, most parks and recreational areas provide limited picnic facilities such as picnic tables and, possibly, grills on which to cook. However, other than these limited picnic facilities, individuals have had to bring with them all of the other traditional picnic items sufficient to enjoy themselves at a remote facility generally away from their homes. The need to thus bring along all of the various picnic items, for example, forks, knives, spoons, plates, cups, ketchup, mustard, etc., has continuously posed problems with respect to managing the carrying and storing of all of the items, as well as not forgetting any of the items. In variably, some items are either forgotten or, if brought along, not found among the many items brought to the picnic site.

Numerous attempts have been made to provide organizers which efficiently store and handle dinner and lunch items such as plates, knives, forks, etc. For example, U.S. Pat. Nos. 696,790, 1,458,679 and 1,235,097 all disclose some type of lunch or dinner kit, pail or trunk which can store the various items. However, all of these known kits have numerous disadvantages when it comes to picnic use. For example, U.S. Pat. Nos. 1,458,679 and 1,235,097 both make use of a suitcase-like trunk which stores items on both the cover as well as the base portion. In order to access any item therefor, the trunk lid must be either continuously opened or closed or somehow kept open. Under outdoor conditions, this is often difficult to do as the wind would often blow the trunk lid closed. Still further, these known lunch kits are disadvantageously simply set on a table or the like and are subject to being knocked off the picnic table during the various activities that often occur at a picnic. Similarly, the dinner pail described in U.S. Pat. No. 696,790 suffers many of the same disadvantages in that it too is simply placed on a table and can thus be easily knocked over.

Another known camp kit is disclosed in U.S. Pat. No. 177,766. This camp kit provides a trunk-like cabinet which stores various camping items. However, as was noted above with respect to U.S. Pat. Nos. 1,458,679 and 1,235,097, this camp kit likewise is cumbersome and difficult to use in a picnic environment. In fact, all of these known references are directed more toward providing a secure carrying case for campers to travel with rather than meeting the specific demands of picnic usage.

SUMMARY OF THE INVENTION

There is therefore needed a picnic caddy which overcomes the problems with the known camping kits and allows for the efficient storage and handling of common picnic items.

These needs are met according to the present invention by providing a picnic caddy which can be securely mounted to a picnic table or the like and which can store and handle a multiple number of picnic items in an optimum and efficient manner. The picnic caddy according to the present invention includes two main support pillars which are interconnected and held parallel to each other through support brackets. At one end of each of the support pillars there is formed a U-shaped mounting arrangement for securing the picnic caddy to a picnic table. Extending laterally away from each side of the support pillars is a storage tray which can be fixed into the upright support pillars so as to be immovable, or can be hinged thereto so as to easily fold for travelling purposes.

In a preferred embodiment of the present invention, a further storage compartment such as for plates or the like is disposed between the two upright support pillars. At a top end of the support pillars, there can advantageously be located a paper towel rack which serves to further strengthen the picnic caddy structure.

In a further preferred embodiment, cup holders are disposed on exterior portions of each support pillar aligned along the longitudinal axis thereof. Still further, each tray extending laterally away from each side of the upright support pillars can include a storage box centrally arranged thereon. For example, a first storage box on a first horizontal tray can include utensils such as spoons, forks and knives. A second storage box on the second horizontal tray can, for example, be a napkin holder.

It is an advantage of the present invention that the picnic caddy can be securely mounted to a picnic table so as not to be disturbed during the everyday picnic activities. The picnic caddy further provides an efficient arrangement of numerous picnic items for handling a variety of different sized picnic groups. Still further, the novel structure of the picnic caddy allows for a reinforcement of the caddy structure while minimizing the amount of inefficiently used spaced.

These and other objects, advantages and novel features of the present invention will become apparent from the following detailed description of the invention when considered in conjunction with the accompanying drawings.

DETAILED DESCRIPTION OF THE DRAWINGS

Figure 1:
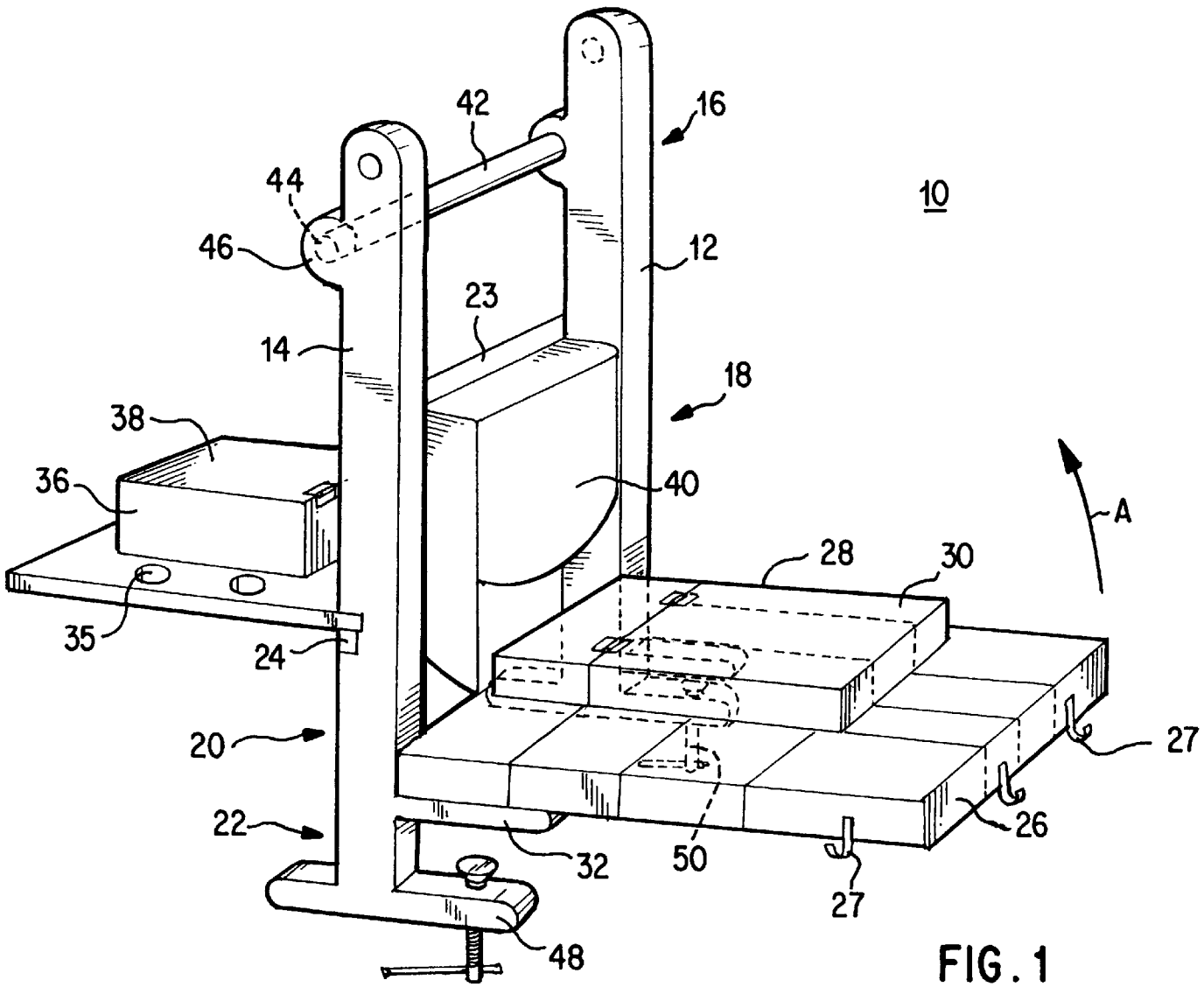
FIG. 1 is a perspective schematic view of a picnic caddy according to the present invention.

Referring to FIG. 1, the picnic caddy 10 includes two main upright support pillars 12, 14. The upright support pillars 12, 14 are arranged parallel to each other and include an upper area 16, a middle area 18, a lower area 20, and a base area 22. Support brackets 23, 24 are used to primarily secure the upright support pillars 12, 14 in a spaced apart parallel relationship. A first storage tray 26 is arranged in the lower area 20 of the support pillars 12, 14 and extends laterally or perpendicularly to the upright support pillars 12, 14.

Arranged either in or on the first support tray 26 is a storage box 28. The storage box 28 includes a lid portion 30 so as not to expose the contents thereof to the outside elements.

The first tray 26 is coupled to the upright support pillars 12, 14 in the lower area 20. For example, the first tray 26 can be fixedly supported on support arms 32 which extend perpendicularly to the upright support pillars 12, 14. Alternatively, the first tray 26 can be hinged to the support pillars 12, 14 so as to easily fold upward as indicated by arrow A to provide a compact arrangement for travelling. Of course, other coupling arrangements can be used as are readily known to those of ordinary skill in the art without departing from the spirit and scope of the present invention.

On the opposite side of the support pillars 12, 14 away from the first tray 26, there is arranged a second storage tray 34. The second storage tray 34 likewise extends laterally away from the upright support pillars 12, 14 in a middle region thereof. In a preferred embodiment, the second storage tray 34 includes drink holders 35 formed therein which can hold a drink such as maybe contained in a cup or can.

In a manner similar to the first storage tray 26, the second storage tray 34 also includes a storage box 36 having a lid 38 thereon. Again, this storage box 36 is centrally arranged on the second storage tray 34 such that, in certain preferred embodiments, the drink holding apertures can extend around the circumference thereof.

In certain preferred embodiments, one or both of the trays 26, 34 can be provided with hooks 27 around their outer parameter. The hooks can be used to hang cooking utensils and towels.

A soft storage compartment or bag 40 is arranged so as to hang in between the upright support pillars 12, 14 in the middle region 18 thereof. This storage bag or sack 40 can be used, for example, to hold picnic plates and the like. In this respect, the spacing between the upright support pillars 12, 14 is sufficient so as to allow for full size plates to be arranged therebetween in the storage sack 40. The storage bag 40 can, for example, be mounted to the inner surfaces of the upright support pillars 12, 14 and/or to the support brackets 23, 24 extending therebetween.

In the upper region 16 of the upright support pillars 12, 14 there is located a towel rack 42. The towel rack 42, which for example can hold a roll of paper towels for picnic use, extends between the upright support pillars 12, 14. Each end of the towel rack 42 is arranged to extend through a towel rack slot 44 provided on a bulged out portion 46 of the upright support pillars 12, 14. In this manner, the towel rack 42 further strengthens the picnic caddy structure 10 so as to prevent any skewing or twisting of the upright support pillars 12, 14 with respect to each other.

In the base portion 22 of the upright support pillars 12, 14, there is provided a mounting arrangement for securing the support pillars 12, 14 in an upright position to a picnic table or other horizontal surface. In the embodiment shown in FIG. 1, this mounting structure is formed between the support projections 32 and a clamping leg 48 provided on each support pillar 12, 14. In this manner, an end face of a picnic table or other horizontal surface can be inserted between the projection 32 and base leg 48. The use of the support projection 32 and base leg 48 provides the upright support pillars 12, 14 with an integral support such that the support pillars 12, 14 cannot tip over. Further, table clamps 50 are shown in the preferred embodiment of FIG. 1 extending upward through the base leg 48 so as to fixedly secure the picnic table against the support projection 32. Of course, other known mounting arrangements can be used so long as they provide a secure mounting of the support pillars 12, 14 in a vertical relationship with respect to the picnic table or the like.

Figure 2:
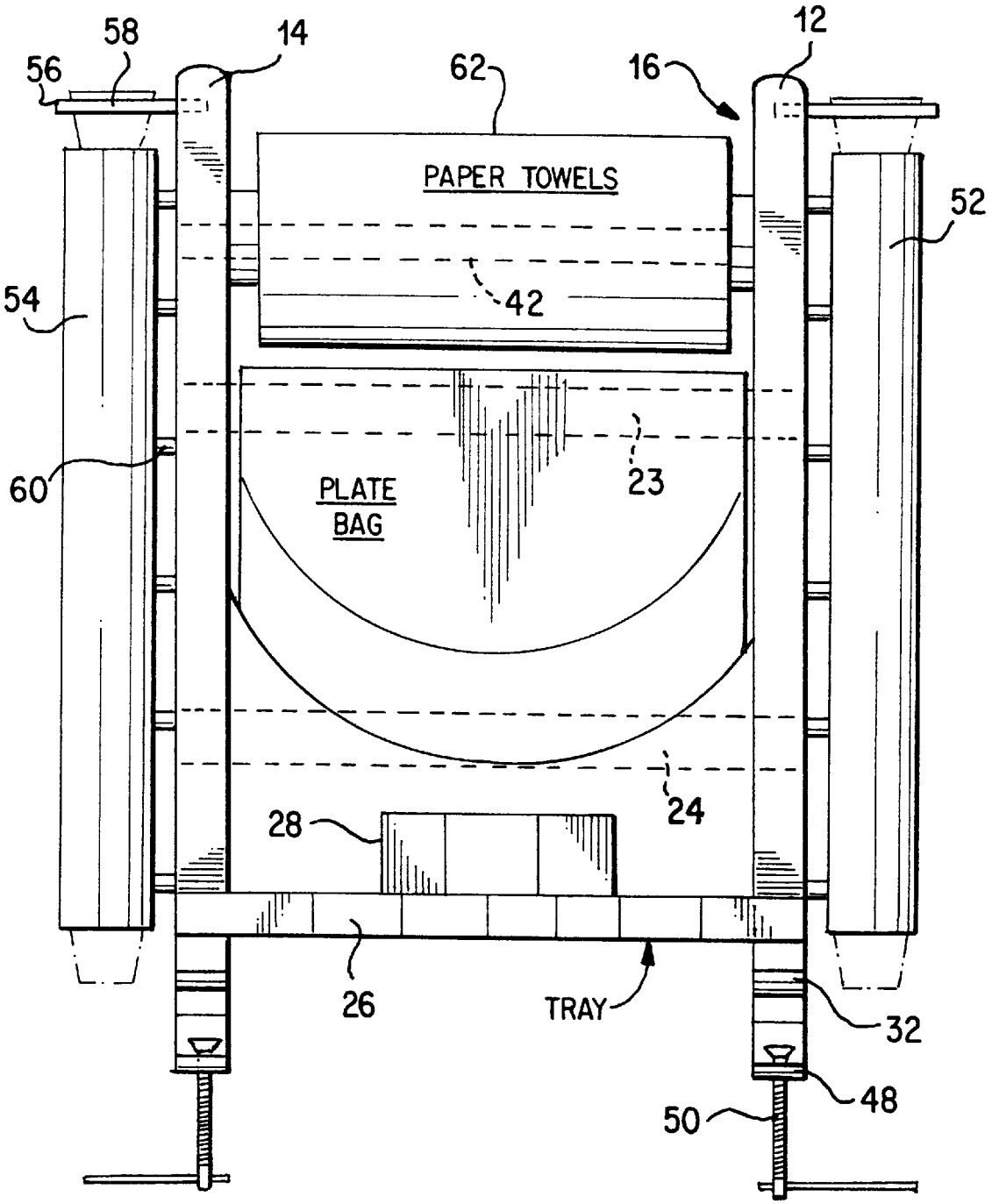
FIG. 2 is a front schematic view of the picnic caddy according to FIG. 1.

Referring to FIG. 2 where like reference numerals are used to denote like parts, a front view of the picnic caddy 10 is shown which further includes cup holding bags 52, 54, one of which is arranged on each support pillar 12, 14. The cup holding bags 52, 54 are supported from a support pin 56 which extends laterally away from the top portion 16 of the upright support pillars 12, 14. For example, the support pin 56 can include snaps or another fixing arrangement that mate with corresponding snaps on the cup holding bags 52, 54. Still further, further mounting structures such as snaps 60 can be vertically arranged along the longitudinal axis of the upright support pillars 12, 14 for maintaining the cup holding bags in a fixed relationship thereto. In certain preferred embodiments, the cup holding bags 52, 54 can be formed of different sizes, for example, 7 oz. and 16 oz. cup sizes, and can be made of vinyl, cloth, or canvass material. The cup holding bags 52, 54 can also be provided with zippers extending along their longitudinal length to allow for easy access and insertion of the cups into the storage bags.

As also shown in FIG. 2, a paper towel roll extends between the upright support pillars 12, 14 and is arranged on the towel rack 42.

Figure 3:
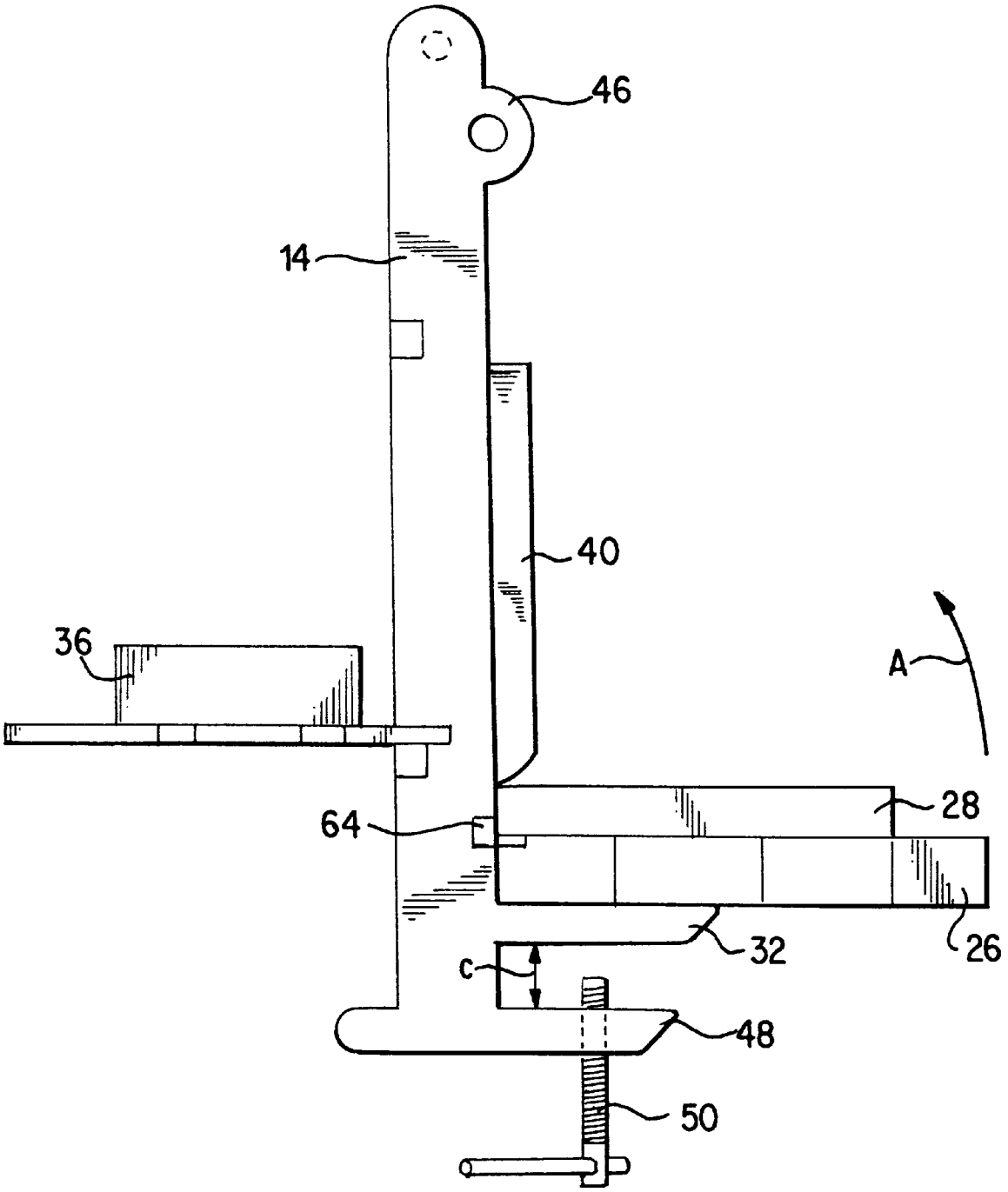
FIG. 3 is a side view of the picnic caddy according to FIG. 1.

FIG. 3 shows a side view of the picnic caddy according to the present invention. In FIG. 3, the first storage tray 26 is shown hinged to the upright support pillar 14 via hinge 64. In this manner, the storage tray 26 can swing upward as indicated by arrow A and can be provided with a securing strap (not shown) for securing its outer region to the upper region 16 of the support pillars. In a similar manner, the second storage tray 34 can likewise be hinged so as to provide an efficient and compact construction for travelling purposes.

Figure 4:
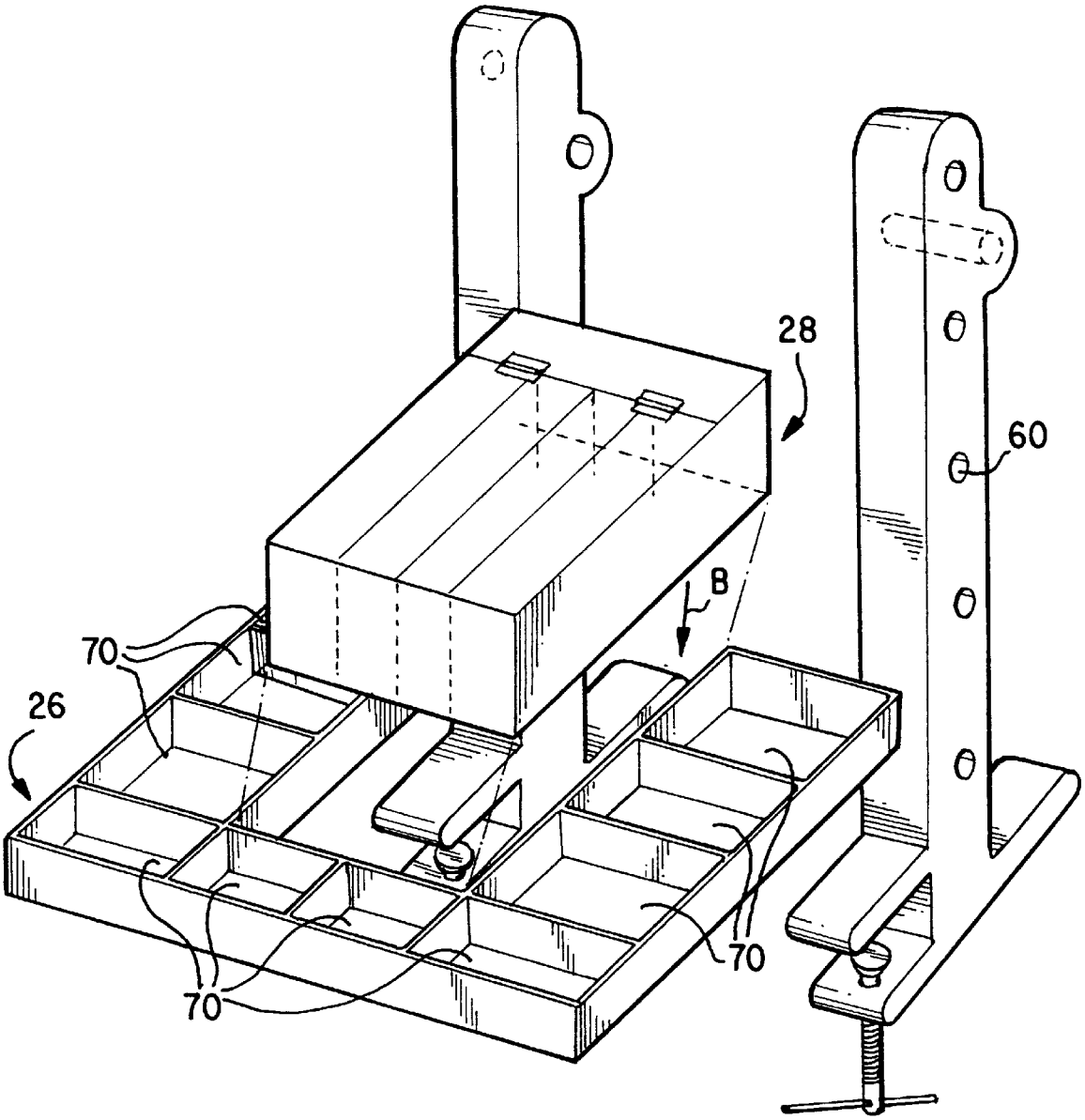
FIG. 4 is an exploded view of a first side of the picnic caddy according to the present invention illustrating the various storage compartments arranged therein.

Referring to FIG. 4, there is shown an exploded view of a first side of the picnic caddy 10 having the first tray 26 and storage box 28. As seen from FIG. 4, the storage box 28 can be removably inserted into the storage tray 26 as indicated by arrows B. Further, various usages for the different compartments 70 for the storage tray 26 are shown. For example, the storage tray 26 can include compartments for ketchup, cleaning wipes, CD's or tapes, breath mints, playing cards, toothpicks, matches and other miscellaneous items. Further, compartments can be provided for salt, pepper as well as other cooking and eating spices. In a similar fashion, the storage box 28 can be provided with various utensil compartments for spoons, forks, knives and the like. Of course, the number and size of the various compartments can all be varied without departing from the spirit and scope of the present invention.

In certain preferred embodiments, the picnic caddy 10 will have an overall height of approximately 2' to 3' and preferably 25½". The overall width of the picnic caddy excluding the cup holders will be preferably in the range of 1' to 2' and most preferably 16". In this manner, the front tray 26 can have a preferred width of 16" and a length extending away from the upright support pillars of approximately 12". The utensil tray 28 should be sized sufficiently to accommodate ordinary utensils including stainless steel as well as plastic utensils. In certain preferred embodiments, the length of the utensil box 28 will be approximately 10" with a width of approximately 8".

Still further in certain preferred embodiments, the second storage tray 34 will have a length extending away from the support colors of approximately 8" to 10" and a width of approximately 16". Again, the storage box 36 should be sized to accommodate ordinary picnic napkins and preferably can be approximately 7"×7" square.

Again in certain preferred embodiments, the mounting or clamping area 22 can have a base leg 48 of approximately 8" and a support projection 32 of approximately 4¼". The space C (see FIG. 3) between the support leg 32 and base leg 48 should be sized so as to accommodate standard or regulation size picnic tables and the like. In certain preferred embodiments, this spacing C will be approximately 3". It is advantageous to use a table clamp as shown in the figures. In certain preferred embodiments, a half-inch table clamp is preferred.

The picnic caddy 10 according to the present invention can be formed of any known material that is sufficiently sturdy and lightweight such as plastic, wood, aluminum and the like.

In use, the picnic caddy 10 according to the present invention provides a sturdy and upright organizing structure that can be simply and securely mounted to a picnic table for outdoor and/or indoor use. The picnic caddy includes a number of useful compartments for storing all of one's picnic needs. Further, the upright support pillars 12, 14 of the picnic caddy make efficient use of the space therebetween for a paper towel rack as well as a storage sack for plates and the like which increases the support structure for the picnic caddy as well as shelters the fragile plates from any nearby picnic activity. As a result, the picnic caddy is easy to assemble and use and allows for maximum enjoyment of one's picnic.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A picnic caddy, comprising:

first and second upright support pillars arranged in a parallel spaced apart relationship to one another;

a clamping mechanism arranged at one end of said first and second upright support pillars;

a first tray extending laterally away on one side from said first and second support pillars;

a second tray extending laterally away from another side of said first and second support pillars;

wherein said first and second trays are connected to opposite sides of said first and second upright support pillars; and wherein said clamping mechanism includes a U-shaped portion into which a horizontal surface is inserted, said clamping mechanism further including a clamping member for dressing the horizontal surface against a side of said U-shaped portion.

2. A picnic caddy according to claim 1, further comprising:

a rod extending between said first and second upright support pillars at an upper region thereof, the rod being free to rotate about its longitudinal axis; and wherein said first tray extends laterally away from said first and second upright pillars in a lower region thereof and said second tray extends laterally away from said first and second upright pillars in a middle region thereof.

3. A picnic caddy according to claim 2, further comprising:

a sack arranged between the first and second upright pillars in the middle region thereof, said sack being mounted so as to hang between said first and second upright pillars.

4. A picnic caddy according to claim 3, further comprising:

a first storage box arranged on or within said first tray; and a second storage box arranged on said second tray.

5. A picnic caddy according to claim 4, wherein each of said first and second storage boxes are provided with lids.

6. A picnic caddy according to claim 4, wherein said first tray is provided with a plurality of compartments for holding various items.

7. A picnic caddy according to claim 4, wherein said second tray is provided with drink holding apertures arranged around an outer region thereof and surrounding said second storage box.

8. A picnic caddy according to claim 4, wherein at least one of said first and second trays are provided with hooks on their outer periphery.

9. A picnic caddy according to claim 4, wherein said sack has a shape and size to accommodate picnic plates.

10. A picnic caddy according to claim 4, wherein said first storage box includes a number of compartments for holding utensils.

11. A picnic caddy according to claim 4, wherein said second storage box is shaped so as to hold a plurality of picnic napkins.

12. A picnic caddy according to claim 4, further comprising at least one further storage sack arranged so as to extend along a longitudinal axis of one of said first and second upright support pillars on an exterior side thereof.

13. A picnic caddy according to claim 12, wherein said further storage sack is designed to hold various sized cups, and includes a zipper extending along a side thereof.

14. A picnic caddy according to claim 2, wherein said rod is a towel rack for holding paper towels.

15. A picnic caddy according to claim 1, further comprising support brackets extending between said first and second upright support pillars in a mid region thereof, said support brackets connecting said first and second upright pillars in a reinforcing manner.

16. A picnic caddy according to claim 1, wherein at least one of said first and second trays are hingedly connected to said first and second upright support pillars so as to pivot into an upright position substantially parallel with said upright support pillars for travelling purposes.

17. A picnic caddy, comprising:

first and second upright support pillars arranged in a parallel spaced apart relationship to one another;

means for securely mounting, arranged at one end of said first and second upright support pillars, the first and second support pillars in a vertical relationship;

a first tray extending laterally away on one side from said first and second support pillars;

a second tray extending laterally away from another side of said first and second support pillars;

wherein said first and second trays are connected to opposite sides of said first and second upright support pillars.

18. A picnic caddy, comprising:

first and second upright support pillars arranged in a parallel spaced apart relationship to one another;

a clamp arranged at one end of said first and second upright support pillars;

a first tray extending laterally away on one side from said first and second support pillars;

a second tray extending laterally away from another side of said first and second support pillars;

wherein said first and second trays are connected to opposite sides of said first and second upright support pillars.

* * * * *